United States Patent [19]

Steiger et al.

[11] 4,181,584

[45] Jan. 1, 1980

[54] METHOD FOR HEATING ELECTROLYTIC CELL

[75] Inventors: Roger A. Steiger, Canal Fulton; Calvin B. Holden, Doylestown, both of Ohio

[73] Assignee: PPG Industries, Inc., Pittsburgh, Pa.

[21] Appl. No.: 8,311

[22] Filed: Feb. 1, 1979

Related U.S. Application Data

[63] Continuation-in-part of Ser. No. 966,836, Dec. 6, 1978.

[51] Int. Cl.[2] ..... C25C 3/06; C25C 3/16; C25C 3/26; C25C 3/34

[52] U.S. Cl. ..... 204/67; 204/64 R; 204/64 T; 204/65; 204/68; 204/70; 204/243 R

[58] Field of Search ..... 204/64 R, 64 T, 65, 204/67, 68, 70, 243 R, 243 M

[56] References Cited

U.S. PATENT DOCUMENTS

| | | | |
|---|---|---|---|
| 3,960,696 | 1/1976 | Wittner | 204/243 R |
| 4,045,307 | 8/1977 | Turley | 204/243 M |
| 4,071,420 | 1/1978 | Foster et al. | 204/67 |

*Primary Examiner*—Howard S. Williams
*Attorney, Agent, or Firm*—Irwin M. Stein

[57] ABSTRACT

A method is described for heating an electrolytic cell used for the production of metal, e.g., aluminum, by electrolysis of a molten electrolyte which contains solid electrolyte between adjacent surfaces of the anode and cathode of the cell. In the described method, holes are drilled in the solid electrolyte, e.g., to the floor of the cell, to provide space for supporting blocks. The holes are spaced a predetermined distance apart to position at least one anode between them. Supporting blocks with a length sufficient to extend from the floor to at least the level of the solid electrolyte beneath the anode are placed in the holes and a resistance heater, preferably one having a positive change in resistivity with temperature, is disposed between the supporting blocks at least one of which is electrically conductive. The anode of the cell is lowered into electrical contact with the resistance heater and current sufficient to heat the resistance heater to at least the melting temperature of the electrolyte, is passed from the anode through the resistance heater. Heating of the resistance heater is continued until the solid electrolyte in the cell has melted. Thereafter, the anode is raised out of electrical contact with the resistance heater, the heater and supporting blocks are removed and the anode is lowered to its normal position for electrolysis.

21 Claims, 2 Drawing Figures

METHOD FOR HEATING ELECTROLYTIC CELL

CROSS REFERENCE TO RELATED APPLICATIONS

This application is a continuation-in-part of our U.S. application Ser. No. 966,836 filed Dec. 6, 1978 and entitled METHOD FOR HEATING ELECTROLYTIC CELL.

DESCRIPTION OF THE INVENTION

In the electrolytic production of some metals, an electrolyzing current is passed from the anode to the cathode of an electrolytic cell through an electrolyte comprising a molten compound of the metal, which compound can also be dissolved in a molten solvent. One of the more common metals produced by such a process is aluminum.

The electrolytic cell in common use today for the preparation of aluminum is of the classic Hall-Heroult design, i.e., the Hall cell. This cell typically utilizes a carbon anode and a carbon cathode, which also, serves as the bottom or floor of the cell. The carbon anodes extend into the cell from above and make contact with the electrolyte. Current collector bars, usually of steel, are embedded in the carbon bottom and are connected electrically to the cathodic side of the source of current. The electrolyte used typically consists primarily of molten cryolite in which is dissolved alumina and which contains other material such as fluorspar. Molten aluminum resulting from the reduction of alumina accumulates at the bottom of the electrolytic cell as a molten pool over the carbon-lined bottom and serves as a molten metal cathode.

In the aforesaid electrolytic production of metals, e.g., aluminum, electrolysis can be interrupted by a loss of power or other operational problem. If the cell temperature cannot be maintained during the power outage at a level at which the metal and electrolyte remain molten, they will be removed from the cell, if possible. As the cell cools, molten metal and electrolyte that is not removed will solidify to a hard mass that is not easily removed when the cell is to be restarted.

In the electrolytic production of aluminum in the Hall cell, solidification of the molten aluminum pad and/or molten electrolyte in the cell produces a condition that is a significant obstacle to restarting electrolysis by the technique used to begin electrolysis initially. The technique commonly in use today for starting a Hall cell, i.e., bringing the cell from ambient to operating temperature, e.g., about 950°-1000° C., includes lowering the anode of the cell onto the cathode, e.g., the cell bottom, which may be covered with a layer of coke, and then turning on the electrolyzing current. The heat generated by the electrical contact resistance between the anode and cathode and the resistance of the coke is sufficient to bring the cell to operating temperature. When the cell reaches a sufficiently high temperature, the anodes are raised, molten cryolite or cryolite and molten aluminum is added to the cell, the anode is lowered into the molten cryolite to the desired distance from the cathode and electrolysis begins. However, solidified cryolite is a non-conductor of electricity. Consequently melting solidified cryolite by re-establishing current flow to the anode in contact with it is not considered to be practical. Typically, it is necessary to remove the solidified mass of electrolyte before electrolysis can be re-established. Such removal of solidified electrolyte can result in significant damage to the cell which will require reconstruction of the cell.

It has now been discovered that an electrolytic cell for the production of metal, e.g., aluminum, which contains solid electrolyte between juxtaposed surfaces of the anode and cathode of the cell can be heated by a simple and convenient technique. In this technique, at least two holes are drilled in and through the electrolyte, e.g., to the cell floor. The holes can be positioned on opposite sides of an anode or pairs of anodes, and supporting blocks, at least one of which is electrically conducting, are placed in the holes. The length or height of the blocks is sufficient to extend from the floor to at least the level of solid electrolyte underneath the anode when the holes are drilled to the cell floor. A resistance heater is disposed between the supporting blocks, e.g., by placing it on the supporting blocks, and the anode of the cell is lowered into electrical contact with the resistance heater. When the anode is connected to a source of electric current, current passes sequentially from the anode to the resistance heater and conducting supporting block and then into the cell floor where the current passes to the cathodic collection system of the cell. Sufficient current is passed through the resistance heater to raise its temperature to at least the melting temperature of the solid electrolyte in the cell and preferably to the operating temperature of the cell. However, once the electrolyte and metal (if present) in the cell are molten, electrolysis can be reinitiated and the cell slowly brought to its operational temperature, if such temperature has not already been achieved.

BRIEF DESCRIPTION OF THE DRAWINGS

In the accompanying drawings are illustrated an embodiment of the invention described herein as applied to aluminum reduction cells. In the drawings.

DETAILED DESCRIPTION OF THE INVENTION

The method described herein for heating an electrolytic cell and/or the internal elements thereof is applicable to electrolytic cells used for the electrolytic production of metal from a molten compound of the metal, e.g., a salt or oxide, or a compound of the metal dissolved in a molten solvent. A commercial electrolytic cell to which the present invention is applicable is the Hall-Heroult (Hall) cell for the manufacture of aluminum by electrolysis of alumina. Other metals produced by electrolysis in a fused electrolyte bath include magnesium, sodium, lithium, beryllium, boron, cerium, columbium (niobium), molybdenum, zirconium, tantalum, titanium, thorium and uranium. See, Electrochemical Engineering, by C. L. Mantell, McGraw Hill Book Company, Inc., New York, 4th Ed. 1960, pp 398-427. Electrolytic cells used for the electrolytic production of the aforesaid metals can be heated to their operating temperature or whatever temperature is desired by the method described herein.

Figure 1:
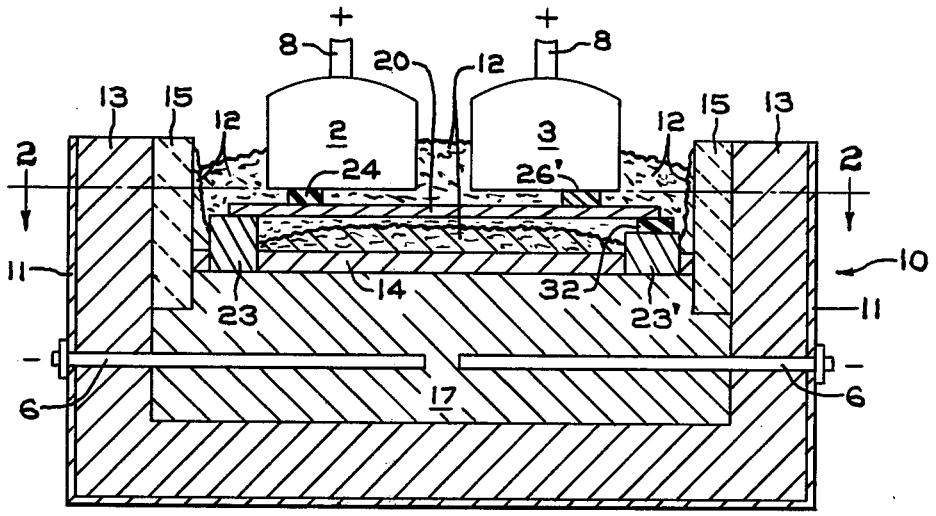
FIG. 1 is a horizontal view, partly in section, of a portion of an electrolytic cell for the production of aluminum illustrating an embodiment of the invention following solidification of the electrolyte and metal pad.

Referring now to FIG. 1, there is shown a horizontal view, partly in section, of a portion of an electrolytic cell 10 for the production of aluminum. The electrolytic cell comprises an outer metal shell 11, e.g., of steel, adjacent to which is disposed insulating lining 13 of a material such as alumina, bauxite, clay, magnesite, or aluminum silicate. Optionally disposed adjacent the insulating lining 13 is refractory wall 15. Such wall can be prepared from a refractory metal compound, such as silicon carbide brick, that is resistant to the conditions existing within the operating electrolytic cell. Inner wall 15 of the cell can also be carbon. Adjacent insulating lining 13 and at the bottom of the cell is floor 17. Commonly the floor is also fabricated from a carbon material, such as anthracite, which has a negative change in resistivity with temperature to minimize the voltage drop across the floor at operating temperature. Floor 17 must be electrically conductive to carry the current from aluminum pad 14 to current collector bars 6. However, if the current were to be conducted from the cell by leads (not shown) connected electrically to aluminum pad 14, the floor could be fabricated from a relatively nonconductive material such as a suitable refractory, e.g., alumina, fused alumina, silicon carbide, silicon nitride, or other material resistant to the temperatures and molten materials with which it comes into contact.

Figure 2:
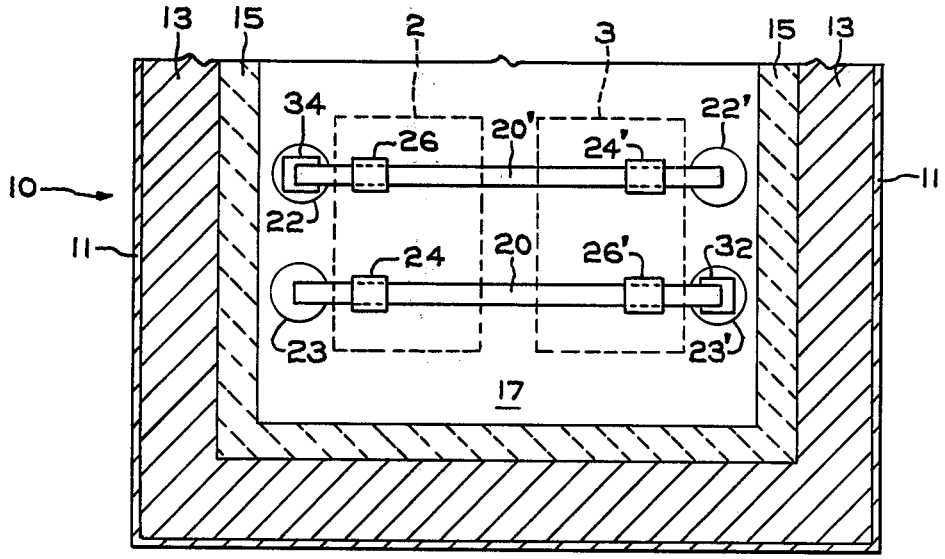
FIG. 2 is a partial plan view of FIG. 1 taken on the line 2—2 of FIG. 1.

The floor and walls of the cell generally define a chamber having a lower zone adapted to receive a pool of molten aluminum (shown as solid) and an upper zone adapted to contain a body or charge of molten electrolyte or flux (shown as solid). Disposed at least partially within the chamber and partially immersed in the electrolyte layer are a pair of anodes 2 and 3, which are usually of carbon, suspended from hangers 8, which can be of aluminum, iron, or copper. The position of the anodes can be adjusted vertically, i.e., raised or lowered, by means well known. The hangers are connected to a bus bar (not shown) to connect the anode to the positive pole of the source of supply of electrolyzing current (not shown). As shown, the upper portion of each anode extends above the level of solidified electrolyte 12. As the anode is consumed during the operation of the cell, it is progressively fed downwards in the well-known manner. The anodes can be of the "prebaked" or the "self-baking" type, as is well known. The anodes are commonly arranged, as shown in FIGS. 1 and 2, in a double row extending the length of the cell, the view in FIG. 1 depicting the end or width of the cell.

Embedded in carbon floor 17 are current collector bars 6. Such bars serve to complete the electrical circuit by connection to a cathode bus system (not shown). Other means for withdrawing current from the cell can be employed also. However, in the arrangement described and during electrolysis, current passes serially from the anode bus system through anodes 2 and 3, the molten electrolyte, molten aluminum pad and carbon base 17 to collector bars 6 and thence to the cathode bus system (not shown) which is connected to the cathode (negative) pole of the source of supply of electrolyzing current.

During operation of the electrolytic cell depicted in FIG. 1, anodes 2 and 3 are immersed in the molten electrolyte and are spaced from the pad of molten aluminum. A crust of solidified electrolyte typically covers the top of the cell and helps to retain the heat generated by electrolysis within the cell. In the event of a power outage or other operational difficulty that requires electrolysis to be discontinued, the cell will cool and the electrolyte (cryolite) and elemental aluminum left in the cell will solidify to a hard mass. This frozen mass of material is not easily removed.

In the practice of the present invention, the frozen electrolyte surrounding the anodes is loosened so that the anodes can be raised away from it. Thereafter, and, if required, solid electrolyte is removed physically to permit the installation of elements described hereinafter in the cell. In one embodiment, a portion of the solid electrolyte laying beneath the anodes is removed to allow installation of a resistance heater.

Referring again to FIGS. 1 and 2, there is shown the portion of frozen electrolyte 12 remaining after a part thereof has been removed to permit insertion of a resistance heater. In a preferred embodiment of the present process, at least two substantially vertical holes, e.g., flat bottomed holes, of the size of supporting blocks 22, 22', 23 and 23' are drilled through the frozen electrolyte 12 and frozen metal pad 14 to the floor 17 of the cell. The holes are spaced a predetermined distance apart to position at least one anode therebetween, i.e., a line drawn between a pair of holes will pass beneath the shadow of the anode. The holes are drilled to at least the top of the metal pad. The depth of the holes can vary, depending on the thickness of the solid electrolyte at the point of drilling. Further, the hole depth can vary from the top of the metal pad to the floor of the cell and even partially into the cell floor. However, the elevation of the bottom of each pair of holes should be the same in order to provide a level resistance heater assembly. In the embodiment shown in FIGS. 1 and 2, the holes are disposed on opposite sides of a pair of anodes. However, the holes can be disposed on the opposite sides of each anode, thereby requiring a pair of supporting blocks and a resistance heater for each anode. In another embodiment, it is contemplated that the holes are drilled in and through the solid electrolyte to at least the surface of the metal pad. As the metal pad softens and melts during heat-up, the blocks will sink to the cell floor under the weight of the anode. The holes (not shown) can be slightly larger than the supporting blocks used in order to permit easy insertion thereof. The hole can be of any convenient geometric shape, e.g., circular, rectangular, square, triangular, etc. Conveniently, the hole will be circular and the supporting blocks also cylindrical in shape. The hole can be produced also by core drilling, i.e., producing a circular bore with the core intact. The supporting block can be solid or hollow, e.g., a solid cylinder or a hollow cylinder which fits into the hole or into the circular bore with the solid electrolyte/metal pad core remaining inside the cylinder. If desired, the hole can be extended into the cell floor 17 a short distance to provide lateral support to the supporting blocks when the frozen metal pad 14 and frozen electrolyte 12 surrounding the block melt and to provide good electrical contact with the cathode system. Care should be taken when drilling into the cell floor to avoid producing a condition conducive to erosion.

As shown in FIGS. 1 and 2, supporting blocks 22, 22', 23 and 23' are electrically conducting and rest on the cell floor. Supporting blocks 22 and 23' are shorter than blocks 22' and 23 by the height of electrical insulating blocks 34 and 32 so that the resistance heater bars 20 and 20', which are shown extending substantially the width of the cell, are substantially parallel to the cell floor 17. On top of resistance heater bar 20 are placed electrical conducting block 26' and insulating block 24 in the manner shown. Similarly conducting and insulating blocks 26 and 24' respectively are placed on top of resistance heater bar 20' but in an opposite arrangement so that anode 2 contacts electrical conducting block 26 and insulating block 24; and anode 3 contacts electrical conducting block 26' and insulating block 24'. Blocks 24, 24', 26 and 26' are of the same height. Although insulating blocks 24, 24' and electrical conducting blocks 26 and 26' are shown positioned off-center under the anodes, it is evident that they can be centered beneath the anodes. Resistance heaters 20 and 20' are shown in the form of rectangular bars which extend almost the width of the cell; however, they can be of any convenient shape or size.

To reheat electrolytic cell 10, anodes 2 and 3 are lowered until they contact conducting block 26 and insulating blocks 24 and conducting block 26' and insulating block 24' respectively directly beneath them. It is also contemplated that the anode can contact the resistance heater bar directly. When current is permitted to flow through anode 3, it passes from the anode through conducting block 26', resistance heater 20 and thence through conducting support block 23 and floor 17 to the cathodic current collection system. Similarly, current flows from anode 2 through conducting block 26, resistance heater 20' and conducting support block 22' to floor 17. Insulating blocks 24 and 24' prevent current from flowing into the resistance heaters upon which they rest. Likewise, insulating blocks 32 and 34 prevent the flow of current from resistant heaters 20 and 20' respectively into the support blocks 23' and 22 upon which they rest. Thus, the current path in the resistance heaters is along the length of the heater.

Although FIGS. 1 and 2 illustrate the use of insulating blocks 32 and 34 on top of supporting, electrically conducting blocks 23' and 22 respectively, it is evident that these supporting blocks can be insulating in character. Thus, for example, blocks 32 and 23' can be combined into a single insulating block of the same height as supporting conducting block 23. As used herein, the term supporting block is intended to mean and include the shaped article supporting the resistance heater whether it is composed of a single article or made up of a series of many articles such as blocks 32 and 23'. Thus, when insulating block 32 is placed on top of block 23', the entire structure becomes the supporting block and serves as an insulator.

In another embodiment, it is contemplated that both blocks supporting the resistance heater are conducting, i.e., blocks 23' and 22 are conducting and are the same height as blocks 23 and 22', and insulating blocks 32 and 34 are eliminated. In this embodiment, the current path through the resistance heaters 20 and 20' is split and flows in two directions. When the anode contacts the resistance heater directly, it is preferred that each resistance heater is contacted electrically by a single anode.

Resistance heater bars 20 and 20' are heated by their internal resistance to the flow of current, and they in turn radiate heat to the interior of the electrolytic cell, i.e., to the solid electrolyte 12, metal pad 14, and the internal elements of the cell, thereby providing the heat to melt the solid electrolyte and metal pad and bring the cell to its operational temperature. Further, that resistance to the flow of current, which is called contact resistance and which occurs at the interface of the various parts of the system, e.g., the anode, resistance heater bar, supporting and conducting blocks and the cell floor, also produces heat which is transferred to the solid electrolyte, solid metal pad and internal elements of the cell by radiation and conduction. The heat produced by the internal resistance of the parts of the heating system, the aforesaid contact resistance and any hot zones that may occur despite precautions to avoid same, are all useful for heating the electrolytic cell. This transfer of heat, principally by radiation, from the resistance heaters and the contact resistance points to the interior of the electrolytic cell results in a gentle heating of the internal elements of the cell to the desired, e.g., operational, temperature. The principal or major source of heat is derived from the resistance heaters.

By interior (or internal elements) of the cell is meant those elements of the cell which are at the operational temperature of the cell during typical cell operation, e.g., the internal walls, floor and other internal parts of the cell. Naturally, the exterior of the cell and layers of material between the exterior and interior of the cell will become heated (by conduction and convection) from the heat present in the interior of the cell. However, insofar as the heat-up method described herein, it is necessary only to heat the internal elements to the desired temperature so that electrolysis can begin. Thereafter, the heat generated during electrolysis will maintain the cell at its operating temperature.

Resistance heaters 20 and 20' are prepared from materials which have the capability of being heated to the temperature desired, e.g., the temperature required for electrolytic cell operation. For example, in the Hall cell, electrolysis is conducted typically at temperatures of between about 950° C. and 1000° C. Consequently, the resistance heaters used in the Hall cell should be capable of maintaining temperatures of at least 950° C., preferably up to 1500° C., for the time required to heat the cell. Thus, the resistance heaters should be of such mass that they will remain substantially intact for at least the period of use. Because of the high temperatures utilized, the resistance heaters, especially graphite heaters, will tend to oxidize if oxygen is present. Oxidation of the heaters can be lessened by shrouding them with a non-oxidizing environment, e.g., an inert gas. To partially reduce oxidation, the top of the cell can be covered with a refractory cover, e.g., Fiberfrax ceramic insulation, which limits the amount of oxygen contacting the heaters. This also helps to retain the heat produced by the heaters in the cell. As the heaters are oxidized, the products of oxidation will fill the space around the heater. In the case of a graphite heater, decomposition products of the heating element, e.g., by disintegration, oxidation, etc., act as an inert shroud gas protecting the heater from continuing and substantial oxidation.

The resistance heater should also be of material that is sufficiently strong to support the weight of the anode which rests on it. Although not critical, it is advantageous if the decomposition products of the heating element, e.g., by disintegration, oxidation, etc., not contaminate significantly the chamber in which it is used so that the metal produced in the cell will be substantially free of such contaminants. Further, the heater should be relatively insoluble in the electrolyte for the time required for heat-up.

The shape of the resistance heater can be designed readily by those skilled in the art. The heaters will operate either at the normal current of the electrolytic cell, at a known fraction of the normal current or at some known current provided by a separate source of power. The electrical resistivity of the heater is also a known factor. With these two known conditions, a skilled artisan can design the heater, i.e., its shape and dimensions, to provide a heater temperature which is sufficient to heat the electrolytic cell to the temperature desired for operation. While that temperature can be the operating temperature of the cell, it can be, of course, lower, thereby necessitating the use of auxiliary methods for completing the heat-up, e.g., charging hot electrolyte to the cell. Preferably, the heater temperature is higher than the cell operating temperature to reduce the heat-up period. In the case of the Hall cell, heater temperatures of from about 900° C. to 2000° C., preferably from about 1000° C. to about 1600° C., can be used.

Resistance heaters 20 and 20' can be fabricated from materials that have either a negative or positive change in resistivity with temperature, i.e., the electrical resistance of the heater decreases or increases respectively with increasing temperature. Preferably, when two or more resistance heaters are used in parallel in one cell the heaters will exhibit a positive change in resistivity with temperature. When the resistance heaters have a negative change in resistivity with temperature, current will flow preferentially through whichever resistance heater has the better initial contact. This heater will increase in temperature and, due to its negative change in resistivity, will conduct a larger and larger share of the total cell current as it heats up. Thus, such a heater will get hotter as it conducts more current while other heaters will cool or remain cool if they had initial poorer electrical contact. Such an event is likely when multiple resistance heaters are used to heat the cell (as is usually the case). When the resistance heater has a positive change in resistivity with temperature, the current flow through a plurality of resistance heaters is self-regulating. Thus, if one resistance heater should become hotter than another, the electrical resistance of the heater with the higher temperature increases slightly and more current therefore flows preferentially through the cooler resistance heater.

Of particular utility for use as the resistance heater in the present invention is graphite, e.g., graphitized petroleum coke. This material has a negative change in resistivity up to about 400°-500° C. but, at higher temperatures exhibits a positive change in resistivity with temperature. When one heater attains a temperature above 500° C., its resistance increases and the current flow through the other resistance heaters becomes greater in a self-regulating sequence. Other carbon materials that could be used for the resistance heater include anthracite, petroleum coke, lamp black and graphitized lamp black. These carbon materials all exhibit a negative change in resistivity with temperature. See, the *Carbon Products Handbook*, page 22, (1964) published by the Carbon Products Division of Union Carbide Corporation. Examples of other non-metallic materials that can be used as the resistance heater element include: molybdenum disilicide and metallic resistance heaters such as those fabricated from platinum, platinum-rhodium alloys, e.g., 87%Pt-13%Rh, 90%Pt-10%Rh, and 60%Pt-40%Rh, Nichrome alloys, and Kanthal alloy heating elements, e.g., 69%Fe, 23%Cr, 6%Al, and 2%Co.

Conducting blocks 22', 23, 26 and 26' are preferably of the same material, as the resistance heater, e.g., graphitized petroleum coke. When not of the same material as the resistance heater, it is preferred that supporting blocks 22' and 23 be fabricated from the identical material, and that conducting blocks 26 and 26' be fabricated from the identical material so that there is equalization of resistance to current flow between anode 2 and anode 3 to carbon floor 17 at any given temperature. As shown in FIG. 2, supporting blocks 22 and 23' have insulating blocks 34 and 32 respectively between them and the resistance heater bar. In that embodiment, the material from which blocks 22 and 23' are prepared is not critical. It can be the same or different than blocks 22' and 23, and can be the same or different than insulating blocks 32 and 34.

The aforesaid supporting and conducting blocks can be fabricated from refractory hard metal (RHM) compositions. The term "refractory hard metals" has been used to specify a group of high melting hard substances which have metallic character, although, on the basis of chemical composition, they would be considered inorganic compounds. Typical representatives of those materials are the carbides, borides, and nitrides of the transition metals in Groups 4b, 5b and 6b of the Periodic Table Of The Elements. This designation of the Groups of the Periodic Table is based on the Periodic Table Of The Elements on the back cover of the Handbook of Chemistry and Physics, 45th Edition, The Chemical Rubber Publishing Company, 1964. A basic text describing the aforesaid refractory hard metals is *Refractory Hard Metals*, by Dr. Paul Schwarzkopf and Dr. Richard Kieffer, The MacMillan Company, New York, 1953. As used herein, the term "refractory hard metal" or "RHM" is intended to mean and include materials comprising the carbides, borides or nitrides of the aforesaid metals, mixtures of such carbides, borides and/or nitrides, and such transition metal carbides, borides, nitrides or mixtures thereof containing additionally minor amounts of other metals, e.g., aluminum and boron, other metal carbides, metal borides, and/or metal nitrides, metal oxides, or carbon, which materials are resistant to the chemical and physical environment of the portion of the electrolytic cell in which they are used. Other carbides and nitrides contemplated are those of boron, aluminum and silicon. Of particular interest for use in the electrolytic production of aluminum are the carbides, borides and nitrides of titanium and zirconium, especially the borides of titanium and zirconium, e.g., titanium diboride and zirconium diboride, and mixtures of titanium and/or zirconium diboride with other metal carbides, nitrides, oxides, free metals, borides, and carbon. See, for example, German patent publication OLS 25 23 423.

Exemplary refractory hard metals include: the borides, carbides and nitrides of titanium, zirconium, hafnium, vanadium, niobium, tantalum, chromium, molybdenum, and tungsten. Compositions described in the United States patent literature, that can be used as RHM articles include: titanium diboride, titanium diboride-titanium carbide, titanium diboride-chromium diboride, titanium diboride-aluminum nitride, titanium diboride-aluminum nitride-boron nitride, titanium diboride-aluminum nitride-aluminum, titanium diboride-boron nitride-titanium nitride, titanium diboride-boron nitride, titanium diboride-boron nitride-aluminum nitride, titanium diboride-titanium nitride, titanium diboride-boron, zirconium diboride-boron, zirconium diboride-cobalt boride, zirconium diboride-cobalt boride-boron, zirconium diboride-carbon-boron, zirconium diboride-titanium diboride, zirconium diboride-silicon carbide, zirconium diboride-silicon carbide-carbon, titanium diboride-titanium carbide-aluminum, and titanium diboride-chromium oxide-aluminum oxide. In the above compositions, titanium diboride, zirconium diboride and hafnium diboride can be interchanged where they are not used simultaneously.

It is preferred that the area of the face of blocks 26 and 26' and supporting blocks 23 and 22', i.e., the faces contacting the resistance heater bar, each be at least twice the cross-sectional area as the resistance heater, i.e., the area represented by the end of the heater, to improve electrical conduction and to reduce the heat produced at the heater-block interface.

Insulating blocks 24, 24', 32 and 34 are of material which is a good electrical insulator and relatively stable at the conditions of use, e.g., temperature. Examples of insulating materials that can be used include: silicon oxynitride, alumina, high alumina refractories, zirconia, aluminum nitride, boron nitride, silicon nitride, and Fiberfrax ceramic (an alumina-silica refractory). In heating a Hall cell, dense alumina can be used advantageously as insulating blocks 24, 24', 32 and 34. Once heat-up is concluded, the alumina can be left in the electrolyte to slowly dissolve and be electrolyzed.

To insure good electrical contact between the anodes, supporting and/or conducting blocks and the resistance heaters, it is contemplated that Grafoil graphite sheets, conducting cement, carbon powder, etc. be placed between the respective contacting surfaces of the anode, supporting and/or conducting block and resistance heater. Use of a conducting medium which can adjust its shape to compensate for geometric irregularities in the articles of construction insures good electrical contact and avoids the formation of hot spots due to poor electrical contact at any of the points of electrical contact.

The number of resistance heater bars beneath each anode can, of course, vary. The total area of heat radiating surface should be adequate to provide the heat necessary to gently and uniformly heat the interior of the cell and melt the solid electrolyte and metal pad in a reasonable time. Preferably, the face of the anode makes physical contact with only one conducting surface, e.g., a conducting block or a resistance heater. Use of one such contact point insures good electrical contact with the anode face. When two or more conducting contact points are used, there is the real likelihood that the rigidly held anode will make good contact with only one of the two or more contact points. Where, however, additional efforts are undertaken to insure good contact at all points, e.g., by the use of layers of Grafoil graphite sheet at each point of contact or between the facing surfaces of the anode and those with which the anode makes contact, or by a specialized anode support designed to permit flexibility of movement, then more than one point of contact beneath the anode can be used. In the embodiment shown in FIGS. 1 and 2, each anode contacts only one conducting point, i.e., conducting block 26 and 26', the other contact point being electrically insulating block 24 and 24'.

In our copending application Ser. No. 966,836 filed Dec. 6, 1978 there are described other resistance heater shapes and positioning in an electrolytic cell for the production of aluminum. Such description represent equivalent embodiments to the one described in FIGS. 1 and 2 and are incorporated herein by reference.

The electrolyte used in the present invention is a molten compound of the metal being produced or a compound of the metal dissolved in a molten solvent. In the case of the electrolytic production of aluminum, a conventional electrolyte containing cryolite, alumina and additives can be employed. Cryolite, in the form of a double salt, is represented by the formula, $Na_3AlF_6$. Typically, the electrolyte contains about eight percent alumina initially and about four to nine percent calcium fluoride. Other additives include lithium fluoride and aluminum fluoride.

It is contemplated that the above-described process will be performed in the following manner, which manner of performances will be discussed in connection with a Hall cell for the electrolytic production of aluminum in which solidification of molten electrolyte and aluminum metal has occurred with the anodes in the position they occupy during electrolysis. In some cases, a portion or all of the molten metal, e.g., aluminum, will be tapped out of the cell prior to complete solidification.

It is contemplated that initially solidified electrolyte will be removed from around the anodes to permit their being raised out of the cell and out of contact with the solid electrolyte. Additional solidified electrolyte may then be removed, if desired, from the shadow of the anodes to provide sufficient space for the resistance heaters to be installed. The amount of electrolyte removed, if any, will depend on the height of the supporting blocks. Thereafter, two pairs of bores, e.g., holes are drilled on either side of a pair of anodes such as shown in FIG. 2. A drill style that forms a flat-bottomed hole is preferred. These bores extend at least through the frozen electrolyte 12 and metal pad 14, if present, to the cell floor 17. An insulating cylinder of dense alumina and a conducting cylinder of graphitized petroleum coke are inserted into each pair of bores as shown in FIG. 2. These cylinders will be of sufficient height (as well as equal in height) to permit the resistance heater to lie substantially horizontally above the level of frozen electrolyte which is present beneath the anodes, i.e., the cylinders are of a length sufficient to extend from the cell floor to at least the height of the solid electrolyte beneath the anode. A graphitized petroleum coke resistance heater bar is then placed across the cell and on top of the oppositely disposed dense alumina cylinder and graphitized petroleum coke conducting cylinder. On top of each resistance heater bar are placed a block of dense alumina (nearest the graphitized petroleum coke cylinder) and a block of graphitized petroleum coke (nearest the dense alumina cylinder), as explained with respect to FIGS. 1 and 2. These blocks will be of equal height. The anodes are then lowered until they each contact the graphitized petroleum coke and dense alumina blocks which have been placed on top of the resistance heater bars. Current is then permitted to flow through the anodes and resistance heaters to raise the temperature of the resistance heater bars to about 1500° C. The flow of current is continued until electrolyte (and metal) has melted sufficiently to reinitiate electrolysis in the resulting pool of molten electrolyte. After the electrolyte and any aluminum metal in the cell have melted, the anode is raised away from the resistance heater bar assembly, and the resistance heater bars and supporting and insulating blocks are removed, the anodes are lowered into the molten pool of electrolyte, positioned a predetermined distance from the cathode, i.e., their normal position for electrolysis, and electrolyzing current passed through the electrolyte, thereby initiating electrolysis.

Although the present process has been described with reference to specific details of certain embodiments thereof it is not intended that such details be regarded as limitations upon the scope of the invention except as and to the extent that they are included in the accompanying claims.

We claim:

1. A method of heating an electrolytic cell for the production of metal by electrolysis of a molten electrolyte in which solid electrolyte is present between adjacent surfaces of the anode and cathode of the electrolytic cell, said cell having vertically adjustable anodes and a floor and walls which define a chamber adapted to contain molten electrolyte, said floor being electrically conductive, which method comprises providing at least one pair of substantially vertical supporting blocks in and through the solid electrolyte, at least one of each of said pair of supporting blocks being electrically conductive, said supporting blocks being spaced a predetermined distance apart to position at least one anode therebetween and being of sufficient height to extend from the floor of the cell to at least the level of solid electrolyte present in the cell beneath the anode, disposing a resistance heater between said supporting blocks, establishing electrical contact between the anode and the resistance heater, passing sufficient current through the resistance heater to raise the temperature of the heater to at least the melting temperature of the electrolyte, and continuing to pass current through said heater until electrolyte in the cell has melted, thereby to heat the cell.

2. The method of claim 1 wherein the resistance heater is graphitized petroleum coke.

3. The method of claim 1 wherein the electrically conductive supporting block is graphitized petroleum coke.

4. The method of claim 1 wherein the supporting blocks in the solid electrolyte rest on the cell floor.

5. The method of claim 1 wherein one of each pair of supporting blocks serves as an insulator.

6. The method of claim 1 wherein electrical contact between the anode and resistance heater is established by lowering the anode until it contacts a conducting block on top of the heater.

7. A method of heating an electrolytic cell for the production of aluminum by electrolysis of a molten electrolyte comprising a compound of aluminum in which solid electrolyte is disposed between juxtaposed surfaces of the anode and cathode of the electrolytic cell, said cell having vertically adjustable anodes and a floor and walls which define a chamber adapted to contain molten electrolyte, said floor being electrically conductive, which method comprises providing at least one pair of substantially vertical supporting blocks in and through the solid electrolyte, at least one of each of said pair of supporting blocks being electrically conductive, said supporting blocks being spaced a predetermined distance apart to position at least one anode therebetween and of sufficient height to extend from the floor of the cell to at least the level of solid electrolyte present in the cell beneath the anode, disposing a resistance heater between said supporting blocks, establishing electrical contact between the anode and the resistance heater, passing sufficient current through the resistance heater to raise the temperature of the heater to at least the melting temperature of the electrolyte, and continuing to pass current through said heater until electrolyte in the cell has melted, thereby heating the cell.

8. The method of claim 7 wherein a pad of solid aluminum is between the cell floor and solid electrolyte.

9. The method of claim 7 wherein the supporting blocks in the solid electrolyte rest on the cell floor.

10. The method of claim 7 wherein the supporting blocks extend into the cell floor.

11. The method of claims 7, 8, or 9 wherein the resistance heater is graphitized petroleum coke.

12. The method of claim 11 wherein the electrically conductive supporting block is graphitized petroleum coke.

13. The method of claim 7 wherein one of each pair of supporting blocks serves as an insulator.

14. The method of claim 7 wherein the current passing through the resistance heater travels in one direction.

15. The method of claim 7 wherein electrical contact between the anode and resistance heater is established by lowering the anode until it contacts the heater.

16. The method of claim 7 wherein electrical contact between the anode and resistance heater is established by lowering the anode until it contacts a conducting block on top of the heater.

17. The method of claim 7 wherein the resistance heater extends substantially the width of the cell.

18. A method of starting electrolysis in an electrolytic cell for the production of aluminum wherein solid electrolyte is present between juxtaposed surfaces of the anode and cathode of the electrolytic cell, said cell having vertically adjustable anodes and a floor and walls which define a chamber adapted to contain molten electrolyte, said floor being electrically conductive, which method comprises providing at least one pair of substantially vertical holes in and through said solid electrolyte, the holes being spaced a predetermined distance apart to position at least one anode therebetween, disposing supporting blocks in said holes, at least one of said supporting blocks being electrically conductive, said blocks being of sufficient height to extend from the floor of the cell to at least the level of solid electrolyte in the cell beneath the anode, disposing a resistance heater between said supporting blocks, establishing electrical contact between the anode and resistance heater, passing sufficient current through the resistance heater to raise the temperature of the heater to at least the melting temperature of the solid electrolyte, and continuing to pass current through the heater until a pool of molten electrolyte is established in the cell, removing the resistance heater from the cell, positioning the anode at a predetermined distance from the cathode within the pool of molten electrolyte, and establishing a flow of electrolyzing current to the anode, thereby to conduct electrolysis of said electrolyte.

19. The method of claim 18 wherein the resistance heater is graphitized petroleum coke.

20. The method of claim 19 wherein the holes in the solid electrolyte extend to the floor of the cell.

21. The method of claim 20 wherein the holes are disposed on opposite sides of a double row of anodes.

* * * * *